United States Patent [19]

Comastri et al.

[11] 4,072,953

[45] Feb. 7, 1978

[54] MULTIBAND ANTENNA FOR WINDOW PANES

[75] Inventors: Mauro Comastri, Monza; Giorgio Ciarniello, Vasto (Chieti), both of Italy

[73] Assignee: Societa Italiana Vetro Siv S.p.A., Vasto, Italy

[21] Appl. No.: 712,342

[22] Filed: Aug. 6, 1976

[51] Int. Cl.[2] ..... H01Q 1/32

[52] U.S. Cl. ..... 343/713

[58] Field of Search ..... 343/711, 713, 712, 720

[56] References Cited

U.S. PATENT DOCUMENTS 3,845,489 10/1974 Sauer et al. ..... 343/713

3,971,030 7/1976 Sauer et al. ..... 343/713

*Primary Examiner*—Eli Lieberman

*Attorney, Agent, or Firm*—Browdy and Neimark

[57] ABSTRACT

A multiband antenna for window panes includes a frame-type antenna component and a fishpole-type antenna component. The two components have a common output terminal. The fishpole component is free of any cross bar. At least one leg of the frame-type component which runs along the lower rim of the window is provided with a succession of horizontally directed S-shaped loops, each loop having a length corresponding to an uneven multiple of wave lengths corresponding to the central frequency of the metric band.

6 Claims, 5 Drawing Figures

MULTIBAND ANTENNA FOR WINDOW PANES

BACKGROUND OF THE INVENTION

The present invention refers to a radio-receiving multiband antenna supported on window panes, particularly for a windshield of motor vehicles. The term "window pane" is intended to mean in this connection a pane of glass or of plastic material and the antenna may consist of electric conductors deposited by the silk screen process on the pane, preferably on that face of the pane which, when fitted into the car, is the internal one; or else, if in lieu of tempered glass, two bonded together glass panes are used, applied to that face of the pane, which is in contact with the other face. Obviously, in lieu of conductors made by the silk screen process, also a conducting metal wire may be used.

Obviously, such antenna may be applied to any window of a motor vehicle, although the windshield is the most suitable place.

The antenna according to the present invention has been designed to receive radio-frequency signals in their various bands of transmissions, such as long waves, medium waves, short waves, metric or frequency modulation waves (FM) and VHF, decimetric waves and UHF and all the waves for sound and/or television information, included the frequencies reserved for radio amateurs.

The antenna incorporated in the pane, particularly in the windshield, is preferred to the conventional, freely supported motorcar antennas, because they are subjected to various drawbacks, such as:

a. considerable vibrations during driving which render the signal fluctuating, particularly when receiving distant stations and the receiver operates in threshold conditions;

b. marked instability in their characteristics, such as increase of their resistance and consequent increase in their losses, changes in the capacity of the antenna, due to its aging, to the possibility of water penetration in the cylindric bottom element, which causes corrosion and oxidation of the tubular elements in a polluting or brackish atmosphere;

c. in the case of fishpole antennas, the fact that they strongly project beyond the motorcar contours, which leads often to their breaking, for instance when entering a garage, an underpass, etc., or damaging persons and goods if they are badly installed;

d. furthermore the fishpole antenna is also subject to be willfully broken by vandals.

For all these reasons windshield antennas have been developed.

It is well known that the major part of radio-receiving sets for motor vehicles is provided with a single aerial socket, differently from the domestic receivers which have an input for the medium waves and one for the metric waves (FM), therefore a problem which must be faced in the aerials embedded in motorcar windshields is that of obtaining good reception of the medium waves as well as of the metric waves in a single antenna socket of the radio-receiving set.

In the prior art various shapes of antennas incorporated or embedded in windshields have been suggested, in an attempt to ensure a good reception in all wave bands. For this purpose antennas have been devised having one central vertical fishpole-type straight or T-shaped element, which afford a good reception particularly in the field of metric waves, and have also been devised antenna elements of greater length which run along the rim of the glass pane, forming so-called "rim" conductors, which afford a good reception in the field of medium waves. However, the problem in these types of antennas with the distinct receiving elements in the various frequency bands is that the signals received by the individual elements conjoin correspondingly to the single input of the radio receiver, and thus it is difficult to obtain a good reception throughout all wave bands, since an antenna built for instance to give a good reception in medium waves is generally not fitted with the characteristics which may confer to it a good yield also in the reception of metric waves and vice-versa. In the prior art there have been suggested types of antennas which were supported on the windshield of a motor vehicle, wherein that part of the antenna which was suitable for a certain frequency band, form an undesirable load when the antenna must operate for a different frequency band and furthermore, in particular in the reception of metric waves, these types of known antennas have a very variable efficiency in the various directions of reception.

SUMMARY OF THE INVENTION

According to the present invention, it has been found that some antenna structures are capable of receiving with an optimum efficiency both the signals in the range of the medium waves (550–1600 KHz) and those in the frequency modulation range (87.5–108 MHz). In fact, the electric characteristics of the windshield antenna according to the present invention excellently satisfy those which are required by the greater part of the radio-receiving sets presently marketed, which require a very high antenna capacity of 70–100 pF (a capacity value which, added to the capacity of the coaxial cable and of the connector permits, by means of the trimmer provided in the receiver, to obtain the best possible tuning between the antenna and the receiver at a capacity around 150 pF) with a high resistance to losses (some hundreds of kohm) in the medium waves band and an antenna impedance of approximately 150 ohm which is prevalently resistive and with a phase contained within $\pm$ 30° within the band of metric waves.

In order to obtain a good reception, the ideal would be to have the length of the antenna conductors equal to a well defined fraction of the wave length $\lambda/2 - \lambda/4$ according to whether the antenna is of the symmetric or assymmetric type.

Since it is impossible, at least for the medium waves, to have wires of the length equal to $\lambda/4$ (187/4 – 570/4 meters) owing to the natural limitations inherent to the windows of a motor vehicle, an antenna has been designed which, although in its reduced development, insures an excellent efficiency of reception both in the medium wave band and in the frequency modulation band.

This has been rendered possible, according to the invention, by adapting the antenna in such a manner that its one section prevalently contributes to the reception of the signal in a given frequency band and another section contributes prevalently to the reception of the signal of another frequency band, but each section contributes also to the section of the signal having a frequency included in the band which is that prevalently received by the other section. In such a manner, in lieu of having two antenna sections, each of which becomes active in the reception of a certain frequency band, while the other section is devoid of any utility or even a source of parasite load as it happens in the prior art — in the antenna according to the invention both sections give an active contribution to the reception of the signal, and therefore this antenna is actually a true and real multi-band antenna which functions in an optimum manner for the most diverse frequency bands and in addition to it with respect to the known technique, it presents a convenient and regular efficiency of reception in all possible directions.

This result has been obtained by an antenna having a geometry such as to satisfy extremely exacting requirements with regard to the impedance of the antenna circuit, by conferring a given configuration to the conductors of the antenna and positioning them with respect to the rims of the windshield in such a manner as to obtain, in the reception of the metric waves, a practically real magnitude of said impedance, approaching the optimum of 150 ohm. To this end the antenna according to the invention comprises a fishpole-type component and a frame-type component bordering the windshield rim, that leg of the frame-type component which borders the lower windshield rim forming a succession of horizontally directed loops, each loop having a length corresponding to an uneven multiple of $\lambda/4$, where $\lambda$ is the wave length corresponding to the central frequency of the metric wave band.

This antenna configuration has the advantage of permitting the compensation of the reactive component of the impedance of the fishpole-type portion within a wide range of desired frequencies. The horizontal loops on the lower windshield rim have also the function of raising the minima of the directivity diagram by actively contributing to the signal pick-up, said contribution being particularly valuable for those directions, wherein the pick-up of the fishpole component is minimal.

The total impedance of the antenna, once it has has been so matched, will vary within the frequency range from 87.5 – 110 MHz between 100 and 200 ohm and transfer in this manner the maximum input to the car radio which requires an optimum impedance of 150 ohm.

The term "matched" is intended to mean that, during reception, the contribution of the receiving element is prevalent, whereas the remaining portion of the antenna gives a contribution of the order 10 – 20° which adds to the other element; in FM the prevalent receiving element is the central fishpole antenna, while in the medium waves the receiving element is the remaining portion of the antenna which runs along the rim of the glass pane, spaced a few centimeters therefrom; the optimum distance from the rim depends on the dimension of the glass pane.

The principle underlying the configuration of the frame-type component for the reception of the medium waves is that of obtaining a maximum possible capacity of approximately 100 picofarad and a high loss resistance.

The choice of the distance of the conductors of the frame-type component from the windshield rim is determined by the capacity which is necessary to minimize the partition of the signal picked up by the antenna and which is fed to the receiver, and is also a function of the windshield size. Since experience proves that the pick-up efficiency is improved when the conductors are spaced farther from the windshield rim it is convenient, when dimensioning the configuration of the antenna, to obtain a correct balance between a good antenna capacity value and a good pick-up efficiency.

This experience has shown that in picking up medium waves with the antenna configurations according to the invention, a good antenna capacity is obtained when the conductors of its frame component are spaced approximately 7 cm. from the windshield rim; to further increase this capacity the conductor running along the windshield rim may be prolonged into an extension running parallel to said conductor but in the reverse direction. When the windshield size permits it and the visibility through the windshield is not impaired, it is advantageous to increase this spacing from the windshield rim to approximately 9 – 10 cm.

BRIEF DESCRIPTION OF THE DRAWINGS

The invention will be better illustrated by the description of the following embodiments, made with reference to the attached drawings, wherein.

DESCRIPTION OF THE PREFERRED EMBODIMENTS

With reference to the figures, all embodiments comprise the aforementioned fishpole-type component extending correspondingly to the vertical center line of the windshield and indicated at 2 in all figures, and the aforesaid frame component bordering all four windshield rims. Both components join at a common terminal 4 for the connection of the antenna to the radio-receiving set, which is located in the vicinity of the lower windshield rim.

Figure 3:
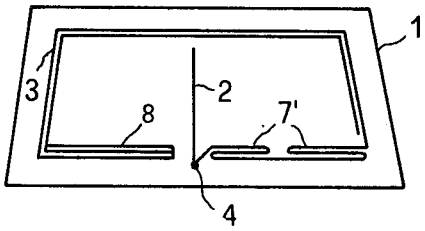
FIG. 3 shows a fourth embodiment of the antenna.
Figure 4:
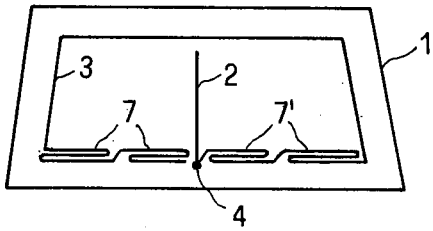
FIG. 4 shows a fifth embodiment of the antenna according to the invention.

The frame component may consist of a single conductor 3, as shown in FIG. 3 and 4. It forms a right lower leg bordering the right half of the lower windshield rim, a right lateral leg bordering the right lateral windshield rim, an upper leg bordering the upper windshield rim up to where, in the vicinity of the left windshield rim, it bends downward to form a left lateral leg and, in the vicinity of the lower windshield rim, it bends inward to form a left lower leg bordering the left lower half of the windshield rim to end short of the antenna terminal 4.

As shown in FIG. 4, at the termination of said lower leg the conductor may be led upward in a hair-pin turn and backward to form an extension which runs parallel to the last mentioned three conductor legs to end short of the right lower leg of the frame conductor.

Figure 1A:
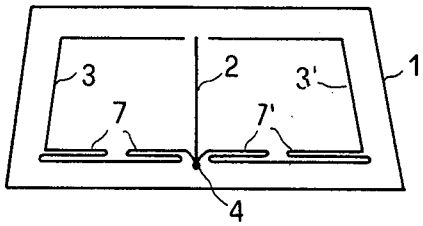
FIG. 1*a* shows a first embodiment of the antenna.
Figure 2:
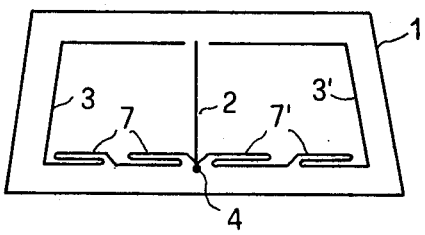
FIG. 2 shows a third embodiment of the antenna.

Alternately, as in the embodiments of FIG. 1*a* and 2, said frame component may consist of two conductors 3, 3', one on each side of the fishpole-type component, which diverge from the antenna terminal 4 along two opposite paths, each conductor comprising a lower leg bordering one half of the lower antenna rim, an upwardly directed lateral leg bordering one lateral rim and an upper leg bordering part of the upper windshield rim to end short of the upper free and of the fishpole-type component 2. Similarly to this embodiment of FIG. 3, the length of the conductors 3, 3' may be increased by hair-pinning them upward and backward at their ends to form on each of them an extension running parallel to their respective upper and lateral legs. FIG.

1*b* shows a variant of FIG. 1*a* obtained in this manner. This arrangement is advantageous for small windshields.

Figure 1B:
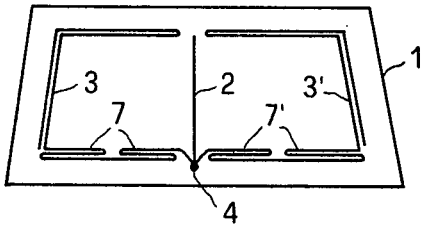
FIG. 1*b* shows a second embodiment thereof.

All embodiments shown, which represent basic forms of the antenna forming the invention, match the impedance value by two interconnected impedances or impedance groups formed by the lower frame conductor legs by conferring to them a looped course. In FIG. 1*a* and 1*b* each lower leg forms two double loops 7, 7′ having the approximate shape of two oppositely facing flattened S's . In the embodiment of FIG. 2, each leg forms two double loops 7, 7′ forming two flattened S's facing towards the antenna terminal, and in the embodiment of FIG. 4, all flattened S's face in the same direction. In the embodiment of FIG. 3, the right lower leg is identical to that of FIG. 1*a* and 1*b*, while the impedance of the rectilinear left lower leg is increased by the addition of a third straight conductor 8 paralleling that part of the extension which adjoins said left lower leg.

It has been found experimentally that the signal pick-up capacity of these embodiments improves if the level of the S's lies at a higher or at least at the same level with the terminal 4, while, if they are positioned at a lower level, these double loops would produce in an unsatisfactory manner, in the metric wave band, the compensation of the reactive component of the fishpole conductor 2. This represents a new criterion in antenna design.

TEST RESULTS

An antenna having the configuration shown in FIG. 1*b* is applied to a glass pane of 60 × 130 cm. and tested. The following characteristics have been found:

| | |
|---|---|
| antenna capacity | 80 pF in the medium wave band |
| resistance loss | >300 kohm in the medium wave band |
| antenna impedance in the 88 – 108 MHz range | 100 – 150 ohm in the metric wave band |
| phase angle | ± 30° in the metric wave band |
| resonance | at 95 MHz in the metric wave band |

These results show that the invention provides an efficient multi-band antenna with excellent pick-up and directionality characteristics and which can be either made from a conducting wire sandwiched between glass or plastic panels or applied to one face of a panel by the silk screen process.

It is clear that many changes and variants may be applied by an expert in the art to the above illustrated embodiments, as for instance in the number and mutual relationships of their loops. Obviously these and other changes and variants are all encompassed in the scope of the present invention.

What is claimed is:

1. A multiband antenna for window panes, the antenna comprising a fishpole-type antenna component and a frame-type antenna component having a common terminal, at least one leg of said frame-type antenna component bordering one window rim and including a succession of series-connected horizontally directed S-shaped loops in a single conductor adjacent said one window rim, each said S-shaped loop having a length corresponding to an uneven multiple of a quarter wave length corresponding to the central frequency of the metric wave band.

2. A multiband antenna according to claim 1, wherein said frame-type antenna component consists of a single conductor starting from said terminal common with said fishpole-type antenna component and bordering all rims of said window pane to end short of said common terminal.

3. A multiband antenna according to claim 1, wherein said frame-type antenna component consists of two conductors, each said conductor starting in opposite directions from said common terminal positioned on the lower end of said fishpole-type antenna component and bordering one half of the window rims to end short of the upper end of said fishpole-type antenna component, the lower leg of each said conductor forming a respective succession of said series-connected, horizontally directed S-shaped loops.

4. A multiband antenna according to claim 1, wherein said fishpole-type antenna component has a single end unconnected to said common terminal and free of any cross bar.

5. A multiband antenna according to claim 2, wherein said fishpole-type antenna component has a single end unconnected to said common terminal and free of any cross bar.

6. A multiband antenna according to claim 3, wherein said fishpole-type antenna component has a single end unconnected to said common terminal and free of any cross bar.

* * * * *